US006302456B1

(12) United States Patent
Errani

(10) Patent No.: US 6,302,456 B1
(45) Date of Patent: Oct. 16, 2001

(54) LATCH-AND-BOLT LOCK WITH SIMULTANEOUS CLOSURE ACTUATION OF BOLT AND LATCH

(75) Inventor: Deo Errani, Faenza (IT)

(73) Assignee: Costruzioni Italiane Serrature Affini C.I.S.A. S.p.A., Farena (IT)

( * ) Notice: Subject to any disclaimer, the term of this patent is extended or adjusted under 35 U.S.C. 154(b) by 0 days.

(21) Appl. No.: 09/565,746

(22) Filed: May 8, 2000

(30) Foreign Application Priority Data

Nov. 5, 1998 (WO) ..... PCT/EP98/07079

(51) Int. Cl.[7] ..... E05B 63/20

(52) U.S. Cl. ..... 292/332; 292/34; 292/165; 70/107; 70/109; 70/110; 70/151 A

(58) Field of Search ..... 70/151 R, 151 A, 70/150, 107, 110, 111, 134, 478, 481, 484, 485; 292/332, 34, 159, 165

(56) References Cited

U.S. PATENT DOCUMENTS

| | | | | |
|---|---|---|---|---|
| 3,769,822 | * | 11/1973 | Yolkowski | 70/107 |
| 4,118,056 | * | 10/1978 | Alexander | 70/151 A X |
| 4,890,870 | | 1/1990 | Miron . | |
| 5,083,448 | * | 1/1992 | Kärkkäinen et al. | 70/277 |
| 5,263,749 | * | 11/1993 | Errani | 292/40 |
| 5,782,114 | * | 7/1998 | Zeus et al. | 70/109 |
| 5,813,255 | * | 9/1998 | Tell, III et al. | 292/165 X |

FOREIGN PATENT DOCUMENTS

| | | | | |
|---|---|---|---|---|
| A1-19514742 | | 10/1996 | (DE) . | |
| A1- 0682167 | | 11/1995 | (EP) . | |
| 115927 | * | 2/1946 | (SE) | 70/151 R |

* cited by examiner

*Primary Examiner*—Teri Pham Luu
(74) *Attorney, Agent, or Firm*—Guido Modiano; Albert Josif; Daniel O'Byrne

(57) ABSTRACT

A latch-and-bolt lock with simultaneous actuation of the bolt and of the latch during closure, the latch and the bolt being actuated by an elastic element so as to protrude from the lock in order to engage in respective selvages of the jamb, the lock including; a sensor for detecting a closed position of a door wheron the lock is fitted, the sensor being movable at right anles to a faceplate of the lock between an external position and an internal position relative to the lock and being retained in the internal position by abutment against the doorjamb; a slider which is guided parallel to the latch; a plate for blocking the bolt, which is guided transversely to the slider; a lever which is articulated to the slider and has a first arm which is operatively associated with the sensor and a second arm which is adapted to assume a position for blocking the latch when the sensor and the latch are inside the lock, a member for the actuation of the plate being arranged on the slider and being such that when the latch, after abutment against the doorjamb, is aligned with the corresponding selvage of the doorjamb, by way of the stroke of the latch for engagement in the selvage, the slider is moved into a position in which the actuation member disengages the plate from the bolt and engages the bolt in the corresponding selvage under the thrust of the elastic element.

6 Claims, 4 Drawing Sheets

LATCH-AND-BOLT LOCK WITH SIMULTANEOUS CLOSURE ACTUATION OF BOLT AND LATCH

CROSS-REFERENCES TO RELATED APPLICATIONS

This application is a continuation of application number PCI/EP 98/07079 filed on Nov. 5, 1998.

BACKGROUND OF THE INVENTION

The present invention relates to a latch-and-bolt block in which the actuation of the bolt into the closure position occurs simultaneously with the closure actuation of the latch.

In latch-and-bolt locks, actuation of the bolt into the closure position can occur only after the latch has already engaged the corresponding selvage, particularly after closing a door from the outside. When a door provided with a latch-and-bolt lock is closed from the outside, the door is first of all set ajar until the latch snaps into the position for engaging the corresponding selvage and then the bolt is actuated into the closure position by means of the key.

However, it can be convenient to have the bolt move into the closure position automatically, i.e., without having to use the key, when the door is closed from outside. The key would be used only to open the door from outside.

SUMMARY OF THE INVENTION

The aim of the present invention is to provide a lock which allows to actuate the bolt into the closure position simultaneously with the engagement of the latch in the corresponding selvage.

Within the scope of this aim, an object of the present invention is to provide a lock in which actuation of the bolt simultaneously with the latch occurs both when closing the door and when opening it.

Another object of the present invention is to provide a lock which is capable of achieving the above aim and object with a structure which is constructively simple and therefore economical and highly reliable in operation.

This aim and these objects are achieved with a lock of the latch-and-bolt type, as defined in claim 1.

BRIEF DESCRIPTION OF THE DRAWINGS

Further characteristics and advantages of the present invention will become apparent from the following detailed description of a preferred embodiment of the invention, illustrated by way of nonlimitative example in the accompanying drawings, wherein.

DESCRIPTION OF THE PREFERRED EMBODIMENTS

Figure 1:
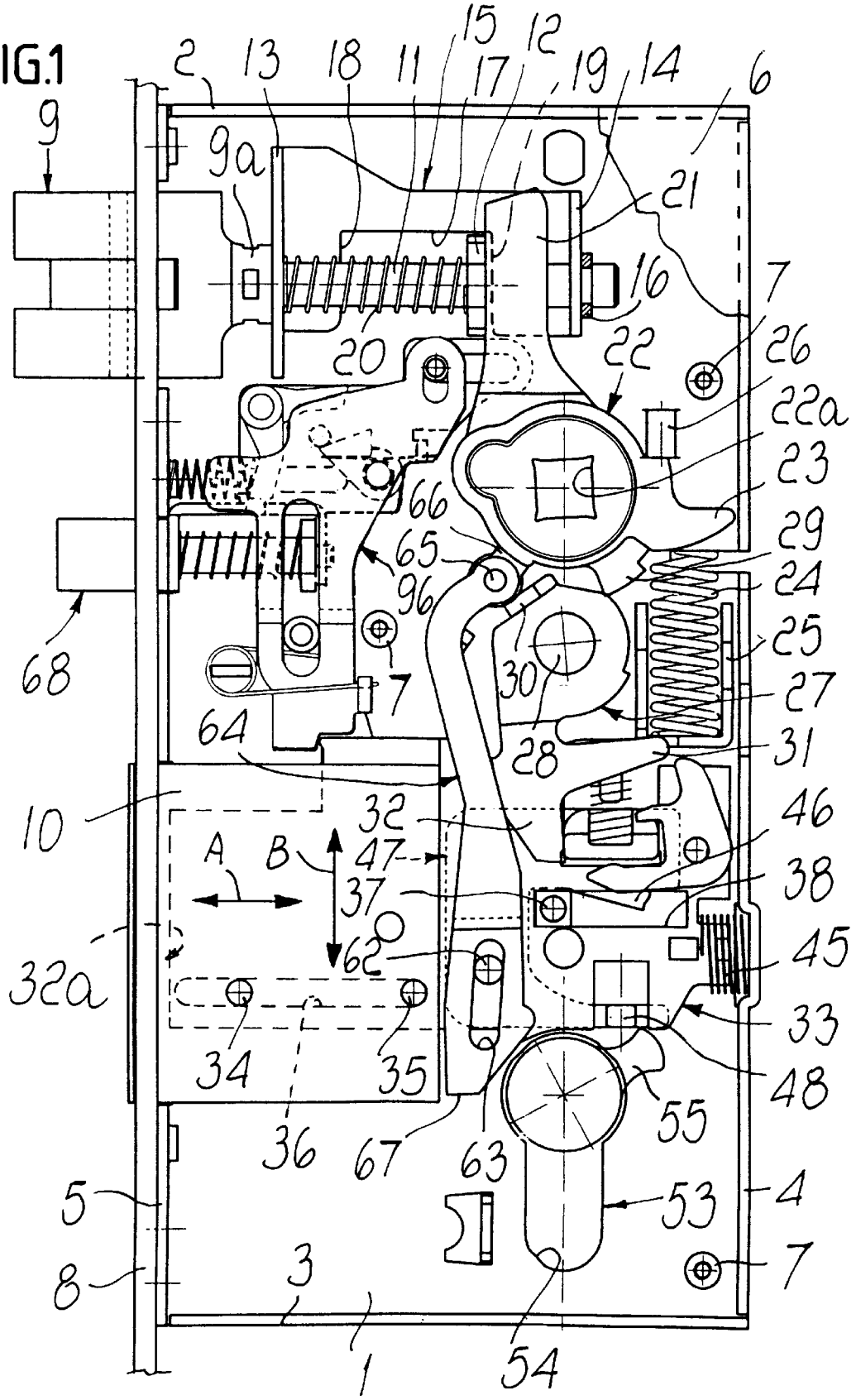
FIG. 1 is a plan view of the inside of the lock according to the present invention.

In the drawings, the reference numerals which designate the constructive elements of the lock are shown on the four figures for the sake of clarity.

Figure 2:
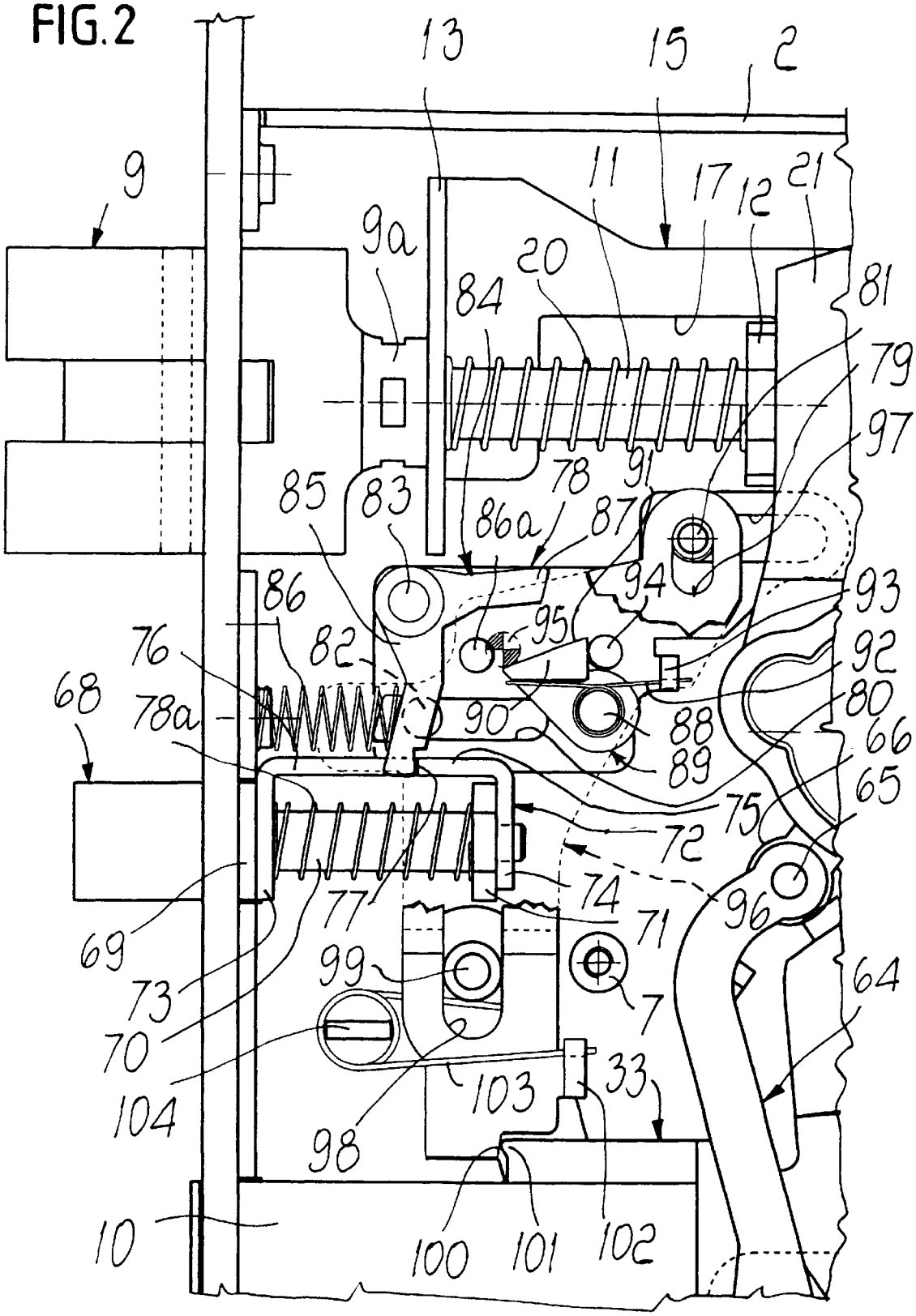
FIG. 2 is an enlarged-scale view of a detail of FIG. 1, with sectional lines in order to better illustrate some internal components.

With particular reference to FIGS. 1 and 2, the lock comprises a case having a flat rectangular prism-like shape.

The case is composed of a bottom wall 1 from which an upper wall 2, a lower wall 3, a rear wall 4 and a front wall 5 protrude upwards, forming a compartment for containing the various parts which is closed by a cover 6 which can be fixed by means of screws which engage respective bushes 7 which protrude into the compartment from the bottom 1.

The case is inserted in a recess of the door and is fixed with the aid of a faceplate 8 which is associated with the front wall 5. The faceplate 8 closes the recess and is fixed by means of screws which are driven through its opposite ends and extend above the upper wall 2 and below the lower wall 3.

The lock comprises a latch 9 and a bolt 10 which are slideable in the direction A and are adapted to protrude from the case through openings of the wall 5 and of the faceplate 8 in order to engage respective selvages of the jamb in the door closure position.

The latch 9 is provided with a stem 11 which is guided through a cross-member 12 which is fixed at right angles to the bottom 1. The stem 11 passes through two wings 13, 14 which are folded at 90° and belong to a bracket 15 which is slideable in contact with the bottom 1 and is retained on the stem 11 by a ring 16. The bracket has a recess 17 which forms two edges 18, 19 arranged on opposite sides with respect to the cross-member 12.

A spring 20 is mounted on the stem 11 and is interposed between the cross-member 12 and the wing 13 and actuates said wing so that it rests on a shoulder 9*a* of the latch 9 and therefore keeps the latch 9 in a position in which it protrudes from the case. In this position, which is determined by the abutment of the edge 19 against the cross-member 12, a space remains between the wing 14 and the cross-member 12; a finger 21 enters the space and is radially rigidly coupled to a hub 22 which is rotatably supported in seats of the bottom 1 and of the cover 6.

A square hole 22*a* is formed in the hub 22 for the engagement of the square pivot of a handle, not shown, which by means of the finger 21 allows to actuate the latch 9 for opening.

The hub 22 has a tab 23 which is radial and arranged at approximately 90° with respect to the finger 21. A spring 24 acts on the tab 23 and rests on a U-shaped element 25 which is fixed internally and adjacent to the rear wall 4 of the case. The spring 24, by acting on the tab 23, keeps the hub 22 in abutment against a raised portion 26 protruding from the bottom 1.

In the above-described lock a panic-safe device is provided which allows, by acting on the handle from the inside, to simultaneously return the latch 9 and the bolt 10 to the opening position, i.e., to the position in which they retract into the case. A device of this kind is described for example in Italian Patents no. 1,233,297 and 1,253,045 in the name of the same Applicant.

Said device comprises a lever 27 which has a pivot 28 in the case and can be rotated by the hub 22 on operation of the handle. For this purpose, the hub 22 has a tooth 29 which is suitable to act on a respective lug 30 of the lever 27.

The lever 27 has a triangular tab 31 and an extension 32 which, by means of a mechanism described hereafter, allow to release and respectively move the bolt into the case of the lock during opening.

A seat 32*a* is formed in the bolt 10 on the opposite side with respect to the one that protrudes from the faceplate 8, and a portion of a plate-like tang 33 is engaged in the seat 32*a*.

The bolt 10 is associated with the plate-like tang 33 so that a movement of the tang is matched by an increased stroke of the bolt. The tang 33 is guided in the sliding direction A by a pair of pins 34, 35 which engage a slot 36 (see also FIG. 4) of the tang, which lies inside the seat 32*a,* and by a square pin 37, which is fixed to the bottom 1 of the case and slidingly engages a slot 38 of the tang portion lying outside the bolt.

Figure 4:
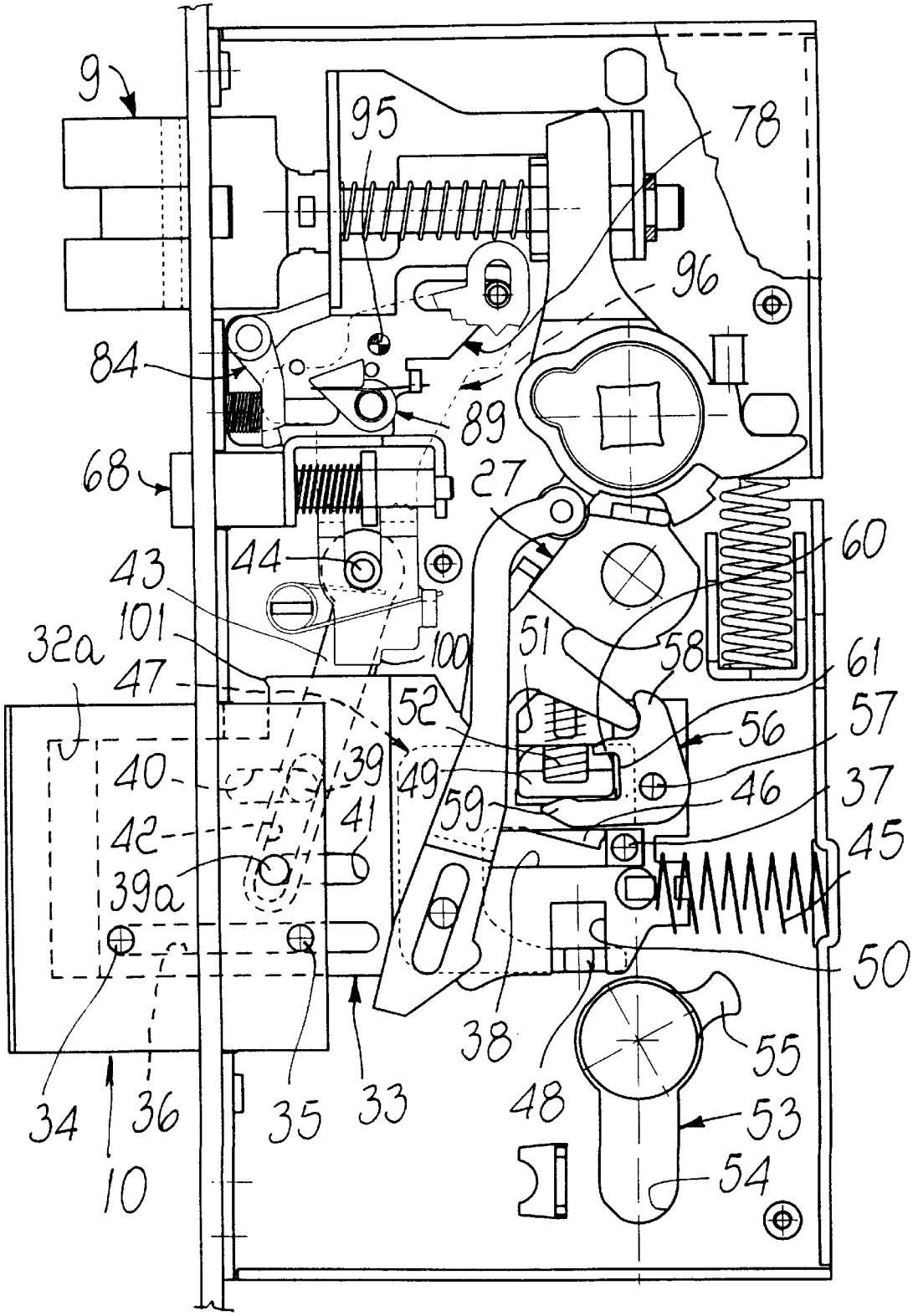

As shown more clearly in FIG. 4, the tang 33 and the bolt 10 are crossed by two pins 39, 39*a;* the first pin 39 is rigidly coupled to the tang and slides in a groove 40 formed inside the seat 32*a,* while the second pin 39*a* is rigidly coupled to the bolt and slides within a slot 41 of the tang.

The pins 39, 39*a* engage a slot link 42 which is formed in a linkage 43 which is supported so that it can oscillate around a pivot 44 which is fixed to the bottom 1 of the case. A spring 45 is interposed between the tang 33 and the rear wall 4 and acts so as to assist the outward movement of the bolt 10 from the case.

The linkage 43 acts as an element for increasing the stroke of the bolt. The linkage 43 in fact converts the stroke of the tang 33 into an increased stroke of the bolt by means of the ratio between the lengths of the arms of the pins 39, 39*a* with respect to the pivot 44, so as to cause an increased protrusion of the bolt from the faceplate 8 and a deeper penetration thereof into the selvage that has to receive it. The square pin 37, besides acting as a guiding member for the tang 33, acts as an element for preventing the sliding of the bolt.

Figure 3:
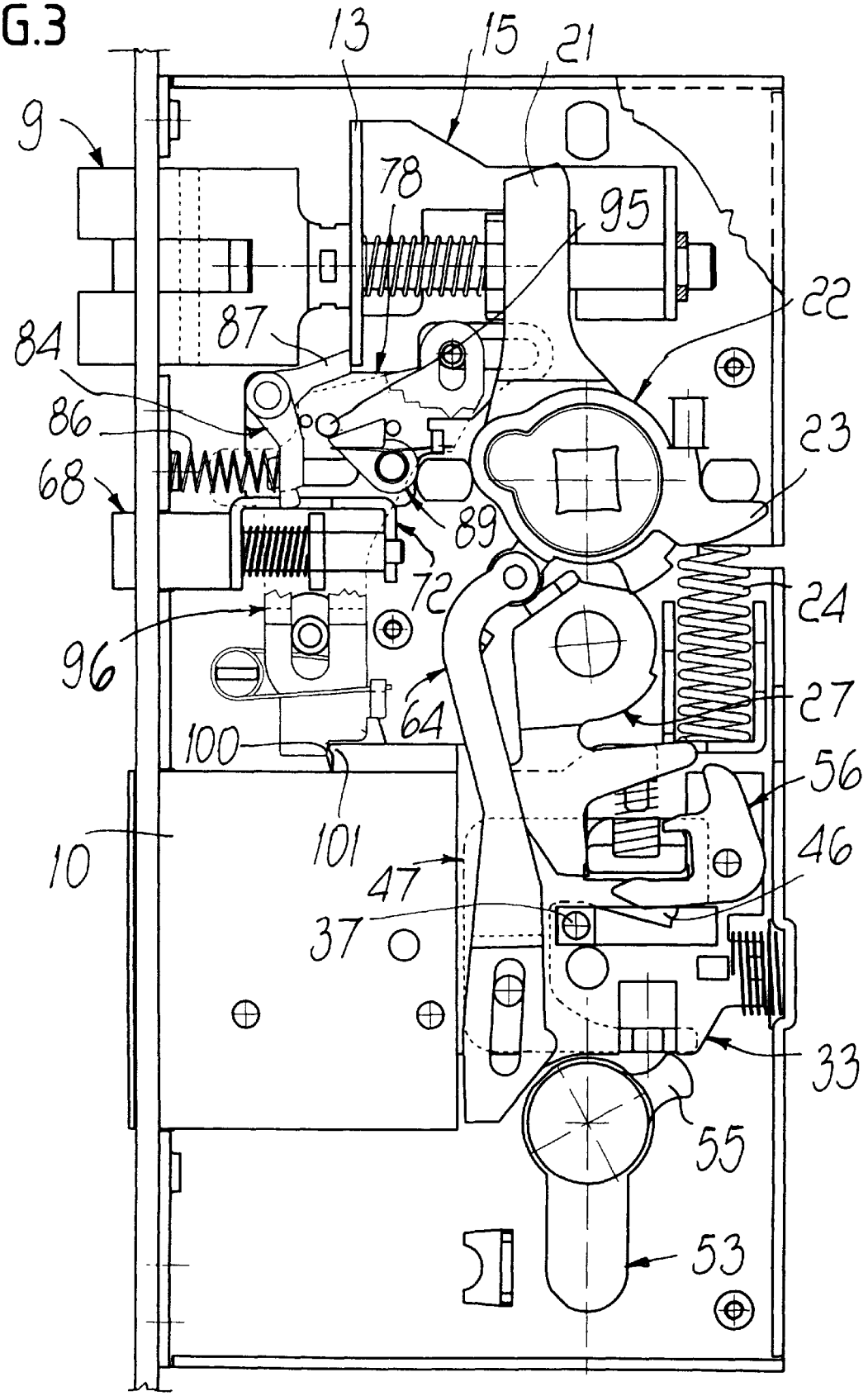
FIGS. 3 and 4 are views of the lock in various operating conditions.

As shown more clearly in FIG. 3, the square pin 37 co-operates with a tooth 46 of a plate like pawl 47 which is substantially C-shaped and is guided in the direction B at right angles to the direction A by the engagement of two wings 48, 49 in respective slots 50, 51 of the tang. The wings 48, 49 rigidly couple the pawl 47 in the direction A to the tang 33, which accordingly, when it moves, shifts the pawl along with it.

The pawl 47 is actuated by a spring 52, in which one end abuts against a tab of the tang and the other end acts on the wing 49, so as to keep the tooth 46 in a position for blocking the pin 37 and therefore blocking the tang 33 and the bolt 10.

In order to release the bolt 10, the pawl 47 is actuated by means of the lever 27, on operation of the handle, or by means of a known type of key-operated cylinder 53, which is adapted to be accommodated in a seat 54 of the case and to act by means of its bit 55 on the wing 48 of the pawl.

The lever 27 acts on the pawl 47 by means of a detent 56 which is pivoted on the tang 33 by means of a pivot 57.

The detent 56 comprises two arms 58, 59 which are arranged in an L-shaped configuration and between which a tab 60 is provided which, together with the arm 59, forms a hollow 61 in which the wing 49 engages. The triangular tab 31 of the lever 27 is meant to act on the arm 58 so as to make the detent 56 rotate so as to allow the arm 59 to act on the wing 49 and therefore lift the pawl 47 to a level whereat the tooth 46 allows the square pin 37 to slide in the slot 38.

The tang 33 is furthermore provided with a transverse pin 62 which is slideable in a slot 63 formed in a linkage 64 which is articulated at one end to a lug 66 of the hub 22 by means of a pivot 65. The end of the lever 64 that lies opposite to the pivot 65 has a flat region 67 which, when the bolt 10 is in the position for retraction into the case, is within the range of action of the bit 55, so as to allow the actuation of the latch by acting on the cylinder 53.

From the above description it is evident that in order to open the lock with the handle, starting from a condition in which both the latch 9 and the bolt 10 are engaged in their respective selvages (position shown in FIG. 4), the rotation of the hub 22, whereto the handle is rotationally coupled, determines by means of the finger 21 the retraction of the latch 9 and at the same time, by means of the engagement of the tooth 29 on the lug 30, the rotation of the lever 27, the triangular tab 31 whereof, by acting on the arm 58, rotates the detent 56 so as to lift the wing 49 and therefore the pawl 33. The upward movement of the pawl 33 releases the square pin 37 and engages the arm 32 against the wing 49, which being pushed toward the rear wall 4 moves with it the tang 33 and the bolt 10.

According to the fundamental prerogative of the present invention, the lock allows to automatically engage the bolt 10 in the respective selvage of the doorjamb simultaneously with the engagement of the latch. In practice this occurs without actuating the handle or cylinder 53 but simply by using the retraction and protrusion motion performed by the latch 9 by first striking the jamb when the door closes and by then engaging the respective selvage under the thrust of the spring 20.

For this purpose, the lock comprises a sensor for detecting the closed position of the door which is constituted by a secondary latch 68 (see FIGS. 1 and 2) which is provided with a flange 69 which is slideable in an opening of the faceplate 8.

A stem 70 protrudes towards the inside of the case from the secondary latch 68, which like the latch 9 has a front chamfer so as to be able to retract into the case when it strikes the jamb. The stem 70 is guided in a cross-member 71 which is blocked between the bottom 1 and the cover 6.

A bracket 72 is fixed on the stem 70 and is provided with two wings 73, 74 which are adjacent to the flange 69 and to the end of the stem. A bridge 75 lies between the wings 73, 74 and is parallel to the stem 70; a chamfer 76 is formed on one edge of said bridge and forms a raised portion 77. A spring 78*a* is arranged on the stem 70 and acts between the cross-member 71 and the wing 73 and accordingly pushes the secondary latch 68 outward.

A slider 78 is arranged above the bracket 70 and is constituted by a plate provided with a pair of slots 79, 80 which are elongated in a direction which is parallel to the direction A. Respective pins 81, 82 engage in the slots 79, 80, protrude from the bottom 1 and guide the slider 78 in the direction A.

An L-shaped lever 84 is articulated in a rocker-like manner on the slider 78 by means of a pivot 83 and has a first arm 85 which is directed downward and whereon a spring 86 acts. When the secondary latch 68 lies outside the faceplate 8, said spring keeps the end of the arm 85 in abutment against the raised portion 77 of the bracket 76, while when the secondary latch is retracted into the case, the spring 86 keeps the arm 85 in abutment against a stud 86*a* of the slider 78. The lever 84 has a second arm 87 which extends from the pivot 83 toward the rear wall 4; when the arm 85 abuts against the stud 86*a,* said arm 87 protrudes from the upper edge of the slider 78 in a position for interfering with the wing 13 of the bracket 15.

A detent 89 is further pivoted, by means of a pivot 88, on the slider 78 and is provided with a raised portion 90 which forms a ramp 91. A spring 92 is wound on the pivot 88 and the opposite ends of said spring abut below the raised portion 90 and below a tab 93 of the slider 78 so as to actuate the detent 89 against a stud 94 for stopping the slider so that the ramp 91 is inclined with respect to the sliding direction A.

The ramp 91 is meant to be engaged by a pin 95 which protrudes from the lower face of a plate 96 (see FIG. 1) which lies above the lever 84, the stem 70 and the detent 89.

The plate 96 has two slots 97, 98 which are parallel to the direction B and in which the guiding pin 81 of the slider 78 and an additional pin 99, rigidly coupled to the bottom of the case, engage.

The lower end of the plate 96 has a step 100 which is suitable to interfere with an edge 101 of the tang 33 and a lobe 102 whereon one end of a spring 103 acts. The spring 103 is coiled on a post 104 which is rigidly coupled to the bottom 1 and whose opposite end abuts against the pin 99. The spring 103 actuates the plate 96 toward the bolt 10 in a position for blocking the tang 33 in which the step 100 abuts against the edge 101 of the tang 33.

The actuation of the bolt 10 simultaneously with the latch during door closure occurs as follows.

When the door is open, the lock is in the condition shown in FIG. 1, in which the latch 9 and the secondary latch 68 protrude from the faceplate 8 and the bolt 10 lies inside the lock. Since the spring 78*a* is stronger than the spring 86, the secondary latch 68 is retained by the spring 78*a* in abutment against the plate 8, while the arm 85 of the lever 84 is retained in abutment against the raised portion 77 of the bracket 72. The second arm 87 of the lever 84 is orientated horizontally and does not interfere with the lower edge of the wing 13. The action of the spring 86 on the lever 84 keeps the slider 78 in a retention position which is determined by the abutments of the pins 81, 82 in the slots 79, 80. The bolt 10 is retained inside the case by means of the step 100 of the plate 96, which locks the tang 33 by engaging the edge 101.

When the door is closed, the latch 9 and the secondary latch 68 make contact with the jamb and are forced to retract into the case of the lock. The retraction stroke of the secondary latch 68 allows the lever 84 to rotate and allows the arm 87 to accordingly assume a position in which it interferes with the wing 13 (see FIG. 3) as soon as said wing has moved beyond the end of the arm 87.

When the latch 9 has aligned with the corresponding selvage in the jamb, it is again pushed outward by the spring 20. The secondary latch 68 instead remains inside the case because it does not have a corresponding selvage.

By means of the outward movement of the latch 9, the wing 13 abuts against the end of the arm 87, the slider 78 is moved toward the faceplate 8 and the pivot 95 engages against the ramp 91 of the detent 89 and therefore the plate 96 is raised in the direction B toward the upper wall 2 in contrast with the return action applied by the spring 103.

This movement causes the disengagement of the step 100 from the edge 101 of the tang 33 and the protrusion of the faceplate of the bolt 10, which is pushed by the spring 45.

The lock is at this point in the transient condition shown in FIG. 4, in which the pin 95 has moved beyond the ramp 91.

At this point, by means of the spring 103, the plate 96 is drawn downward into a position in which it rests on the back of the tang 33 and is ready to be set again by means of the engagement of the step 100 against the edge 101 as soon as the bolt has retracted.

In order to open the lock it is possible to act on the handle, i.e., on the hub 22, or by means of the cylinder 53.

In the first case, as mentioned above, the latch 9 is caused to retract by the finger 21 and simultaneously the bolt is retracted by means of the lever 27 which, after releasing the pawl 47 by means of the triangular tab 31 and the detent 56, acts on the tang of the bolt with the extension 32 by means of the wing 49.

In the second case, first of all the bolt retracts by means of the actuation produced by the bit 55, which by means of a first turn, after lifting the pawl 47 in order to release the square pin 37, moves the tang 33 toward the rear wall 4 and then, by means of a second turn, acts on the linkage 64, which returns the latch 9 to the retraction position by means of the hub 22 and the lever 21.

It is evident that the present invention perfectly achieves the intended aim and objects. In particular, it should be observed that protrusion of the bolt occurs only when the latch has already engaged the respective selvage of the jamb. This ensures perfect alignment of the bolt with its selvage and safe engagement therein.

The present invention is susceptible of numerous modifications and variations, all of which are within the scope of the same inventive concept. In particular, it should be observed that the simultaneous actuation of the latch and of the bolt can be generalized to all locks provided with a latch and a bolt.

The disclosures in Italian Patent Application No. B097AO00673 from which this application claims priority are incorporated herein by reference.

What is claimed:

1. A latch-and-bolt lock with simultaneous actuation of the bolt and of the latch during closure, said latch and said bolt being actuated by elastic means so as to protrude from the lock for engagement in respective selvages of doorjamb, said latch-and-bolt comprising:

a sensor for detecting a closed position of a door when the lock is fitted on the door, said sensor being movable at right angles to a faceplate of the lock between an external position and an internal position relative to said lock, said sensor being retainable in said internal position by abutment against a doorjamb of the door when the lock is fitted on the door;

a slider which is guided parallel to said latch;

a blocking plate for blocking said bolt which is guided transversely to said slider;

a lever which is articulated to said slider and has a first arm which is operatively associated with said sensor and a second arm which is adapted to assume a position for blocking said latch when said sensor and said latch are inside the lock;

an actuation member for the actuation of said blocking plate being arranged on said slider, said actuation member being such that when said latch, after abutment against the doorjamb of the door when the lock is fitted on the door, is aligned with a corresponding selvage of the doorjamb, by means of the stroke of said latch for engagement in said selvage, said slider is moved into a position in which said actuation member disengages said blocking plate from said bolt and engages said bolt in the corresponding selvage under the thrust of elastic means.

2. The lock according to claim 1, wherein said slider is constituted by a sliding plate which is slideable parallel to the latch and whereon said lever is articulated, and in that said actuation member is constituted by an element which is articulated to said sliding plate in contrast with elastic return means and is provided with a ramp which is inclined with respect to the sliding direction of said sliding plate, said ramp being adapted to act, during the movement of said sliding plate performed by the latch, on said blocking plate so as to disengage said sliding plate from said bolt in order to allow said bolt to protrude from the lock when the latch is aligned with the corresponding selvage of the doorjamb of the door when the lock is fitted on the door, so as to produce the simultaneous engagement of said latch and said bolt in the respective selvages.

3. The lock according to claim 2, wherein said sensor is constituted by a secondary latch which is provided with a stem whereon a bracket is fixed which is provided with a raised portion which can be engaged by said first arm of said lever, said secondary latch being able to move in contrast with the return action of a spring which is arranged on said stem, a further spring being provided which keeps said first arm rested against said raised portion when the secondary latch lies outside the lock, while when the secondary latch is retracted into the lock said further spring actuates the disengagement of said first arm from said raised portion and the rotation of said lever into a position in which said second arm interferes with the latch during the stroke of said latch for engagement in the corresponding selvage of the doorjamb of the door when the lock is fitted on the door.

4. The lock according to claim 2, wherein said blocking plate is provided with a step which is adapted to interfere with said bolt and with a pin which can be engaged by said ramp when said plate is moved by said latch during the stroke of said latch for engagement in the corresponding selvage of the doojamb of the door when the lock is fitted on the door, elastic means being provided which act on said sliding plate in order to retain said step in a position for blocking said bolt.

5. The lock according to claim 1, comprising a panic-safe device to actuate a simultaneous retraction of the latch and of the bolt by acting on them by means of suitable lever systems actuated by a handle or by a cylinder.

6. The lock according to claim 1, wherein said bolt is associated, by means of lever systems, with a tang so that a movement of the tang is matched by an increased stroke of the bolt.

* * * * *

UNITED STATES PATENT AND TRADEMARK OFFICE

CERTIFICATE OF CORRECTION

PATENT NO. : 6,302,456 B1
DATED : October 16, 2001
INVENTOR(S) : Deo Errani

It is certified that error appears in the above-identified patent and that said Letters Patent is hereby corrected as shown below:

Title page,
Item [73], Assignee: Costruzioni Italiane Serrature Affini C.I.S.A. S.p.A., Faenza (IT)

Item [30], Foreign Application Priority Data

| | | |
|---|---|---|
| Nov. 14, 1997 | (IT) ... ... ... ... ... ... ... ... | BO97A000673 |
| Nov. 5, 1998 | (WO) ... ... ... ... ... ... ... . | PCT/EP98/07079 |

Signed and Sealed this

Twenty-third Day of April, 2002

*Attest:*

*Attesting Officer*

JAMES E. ROGAN
*Director of the United States Patent and Trademark Office*